US006200193B1

(12) United States Patent
Nadel

(10) Patent No.: US 6,200,193 B1
(45) Date of Patent: Mar. 13, 2001

(54) STIMULUS-RESPONSIVE NOVELTY DEVICE

(76) Inventor: Craig P. Nadel, 20 Tomalyn Hill Rd., Montville, NJ (US) 07045

( * ) Notice: Subject to any disclaimer, the term of this patent is extended or adjusted under 35 U.S.C. 154(b) by 0 days.

(21) Appl. No.: 09/216,241

(22) Filed: Dec. 18, 1998

Related U.S. Application Data

(60) Provisional application No. 60/068,183, filed on Dec. 19, 1997.

(51) Int. Cl.[7] ..... A63H 5/00

(52) U.S. Cl. ..... 446/409; 446/397

(58) Field of Search ..... 446/408, 409, 446/458, 462, 437, 441, 442, 457, 484, 397

(56) References Cited

U.S. PATENT DOCUMENTS 3,659,030 * 4/1972 Scott ..... 446/409
4,466,327 * 8/1984 Hinton ..... 446/408
5,533,920 * 7/1996 Arad et al. ..... 446/458
5,533,921 * 7/1996 Wilkinson ..... 446/409
5,545,071 * 8/1996 Shiraishi ..... 446/408
5,660,575 * 8/1997 Chuang ..... 446/409
5,720,644 * 2/1998 Ku ..... 446/458

* cited by examiner

*Primary Examiner*—Sam Rimell
(74) *Attorney, Agent, or Firm*—Cohen, Pontani, Lieberman & Pavane

(57) ABSTRACT

A novelty device having a housing, a sensing element in the housing for sensing a stimulus and for generating an electrical signal in response to the sensed stimulus, a processor in the housing for receiving the corresponding electrical signal and for generating a responsive control signal, and an output producing device for generating in response to the control signal an output suggesting the presence of a living being trying to escape from within the housing. The output may take the form of a simulated voice asking to be "let out" of the housing, in concurrent combination with a rocking or vibrating or irregular motion of the housing suggesting that the housing is being shaken by the trapped being seeking to escape from within the box.

21 Claims, 5 Drawing Sheets

STIMULUS-RESPONSIVE NOVELTY DEVICE

PRIORITY CLAIM

This application claims priority from co-pending U.S. Provisional Patent Application Serial No. 60/068,183, titled Stimulus Response Novelty Device, filed Dec. 19, 1997.

BACKGROUND OF THE INVENTION

1. Field of the Invention

The present invention relates generally to novelty devices. More particularly, the present invention is directed to a novelty device that is activated by external stimuli.

2. Description of Related Art

Novelty devices for entertaining or amusing individuals are known in the art. Such devices take many forms, from the ubiquitous Slinky toy which has in the past entertained children and adults for hours on end, to the faddish Rubick's cube, which combines aspects of puzzle solving in an engrossing and challenging game. Novelty devices of this nature have always fascinated, and provided harmless distractions for people, thereby relieving stress.

In the class of novelty devices that are devoted to sheer entertainment, many such devices; have utilized moving parts under power in order to grab the attention of individuals and to engage the individual for an extended period of time. Such devices sometimes produce visual, auditory and/or other sensual output to hold the attention of, and entertain, people.

Novelty devices that provide surprising or unexpected responses also engender a sense of amusement in people observing or evoking the response. Others also especially enjoy watching others so they react to such responses, and derive stress relief and entertainment from their observations.

Similarly, novelty devices that operatively react to an external stimulus in some way are particularly intriguing. The element of surprise, combined with a humorous motif, makes a novelty item even more attractive. Numerous different types of such devices are on the market, with new devices appearing regularly.

However, the art has not heretofore provided a novelty device that combines the above-referenced elements and which consistently provides entertainment in a varied and provocative manner. The inventor of the subject matter herein claimed and disclosed has recognized the need for such a novelty device, and has overcome many of the difficulties that are inherent in the design and manufacture of prior novelty devices to achieve advantageous and unexpected results.

SUMMARY OF THE INVENTION

The aforementioned long felt needs are fulfilled, and problems solved, by a novelty item provided in accordance with the present invention. Preferably, the novelty device takes; the form of a substantially closed box or housing including an input signal means for producing, in response to an external stimulus, an input electrical signal, and processing means responsive to the input electrical signal for processing the input electrical signal and producing an activation signal. In addition, the novelty item includes operating means, responsive to the activation signal, for producing an output signal to operate a device that provides a user-perceivable reaction to the input electrical signal for at least a predetermined period of time.

In a particularly preferred embodiment of the present invention, the novelty device reacts to external stimuli by simultaneously producing a plurality of related sensory outputs to entertain a user or observer of the device. The sensory outputs may be, for example, a combination of audio and motion outputs, and may be activated by any of a number of appropriate stimuli such, for example, as touch, sound, a manually-operated pushbutton, light, proximity, infrared illumination, motion or any combination thereof. Olfactory outputs, pure visual outputs, and tactile outputs generated by the novelty device are also contemplated. The audio outputs may simulate or resemble any sound reproducible by an integrated circuit sound chip or other electronic or mechanical device, such for example as a human voice, an animal noise, or a sound effect.

Visual outputs may include, without limitation, flashing lights, moving members or appendages, video or animated features, and the like. All such effects can generally be produced by electronic components which are readily available and known to those of skill in the art. Tactile outputs, as for example heat and cold, may also be provided by novelty devices contemplated in accordance with the invention. All such outputs, of whatever type, are intended to entertain and surprise individuals observing the inventive devices, and can be actuated by the individuals in accordance with the present invention either knowingly, or unknowingly.

The novelty devices described and disclosed herein are safe, effective, and may be powered by standard batteries providing a self-contained power source. The devices may be manufactured from plastic or injection molded material, or may be thermoformed by conventional methods. Thus, the devices taught herein are economical to manufacture. The novelty devices of the present invention provide endless hours of fun and entertainment to individuals using and observing them. Such results have not heretofore been achieved in the art.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals delineate similar elements throughout the several views.

DETAILED DESCRIPTION OF THE CURRENTLY PREFERRED EMBODIMENTS

Figure 1:
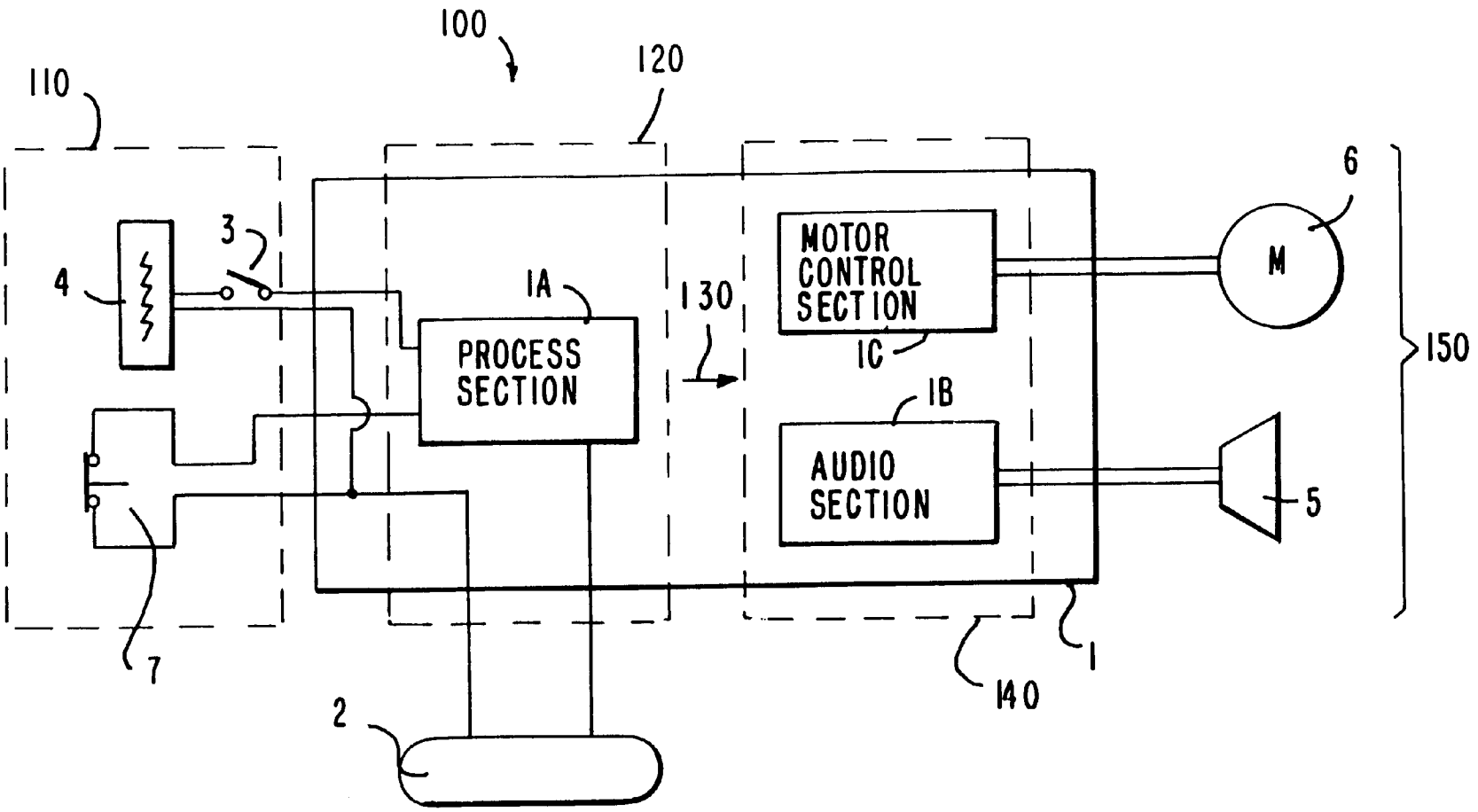
FIG. 1 is a schematic, block diagram of a circuit for use in a novelty device in accordance with the present invention.

As an overview, the present invention provides a novelty device responsive to an input for generating a concurrent plurality of related sensory outputs perceivable by a user or observer of the device for creating a humorous and unexpected reaction from the user or observer. In its currently most preferred implementation, the device takes the outward form of a closed or substantially closed box-like housing. The sensory input that triggers the plural responsive outputs may in the most preferred embodiments comprise a sound, or some externally-induced movement of the housing, or the proximity of a user to the housing, or light of (for example) at least a predetermined amplitude or that is incident on the housing at a particular location thereof or from a particular direction. The outputs are related in the sense that they are of or concern like subject matter or are sufficiently associated as to convey to the user a related, preferably humorous, effect.

In the preferred embodiment, two related outputs are concurrently generated in response to detection of the predetermined sensory input. The first is a motion of the housing, such for example as a rocking or quasi-random movement of the housing, relative to an underlying surface on which the housing supportedly sits, thus simulating efforts by someone or something trapped within the housing to escape. The second output in the preferred embodiment is sound, specifically a simulated human voice, most preferably asking or pleading to be released, as with the phrase "Would somebody please let me out of here?" recited in a manner suggesting an agitated and desperate state. The two outputs in this preferred embodiment are generated concurrently, or at least in part concurrent or overlapping, thus suggesting that there is someone trapped in the box, banging or pressing against its interior walls in an effort to escape and pleading to be released. The result is an extremely humorous and entertaining novelty device that stands up to repeated use without growing tiresome or annoying.

The suggestion that someone or something is trapped in the container or housing of the inventive novelty device can be further enhanced by suitably ornamenting the housing. In a preferred embodiment, the housing—although it may be fabricated of a plastic material to minimize manufacturing expense—resembles a wooden shipping carton or crate and may include simulated shipping labels and the like affixed or applied to or simulated on its outer surface. The container may further include a small opening through which a simulated eyeball can be viewed—as though the person or being trapped therein is peering out through the opening. These and other enhancements for supplementing the effectiveness of the concept of the novelty device are within the intended scope and contemplation of the invention as general matters of design choice.

In the preferred embodiment hereinafter described and illustrated in the drawings, the box-like container encloses a printed wiring board on which at least some of the electronic components that control the operation of the inventive device and generate the audible voice-simulating output are carried, a battery compartment for a self-contained power supply, and a motor that drives an eccentrically-supported or eccentrically-disposed mass for operatively creating the desired semi-random or irregular motion of the housing. The housing may also carry a suction cup affixed to the outer, bottom face of the housing for releasable securement to an underlying support surface, thus facilitating an irregular rocking motion of the housing when the motor is operated to create that output.

Turning now to the drawings, FIG. 1 schematically depicts a circuit 100 for driving the novelty device of the present invention. The circuit preferably comprises an input section 110 for producing an input electrical signal that is bussed or otherwise delivered to a printed circuit or wiring board 1 containing or supporting the various components operable to provide the predetermined effects or outputs in accordance with the invention. The input section 110 may be implemented using any sensor or actuator suitable for generating an output in response to detection of the input condition to be sensed. By way of nonlimiting example, section 110 may comprise a photocell for sensing light, or a capacitive or otherwise implemented proximity sensor for sensing predetermined presence of a portion of the user's body, or a microphone or the like for sensing sound or noise of a predetermined amplitude and/or wavelength, or a motion sensor for sensing motion such as externally-supplied movement of or against the housing.

A processor 120, which is operatively responsive to the input electrical signal received from the input section 110, processes the input electrical signal and produces in response thereto an activation signal 130. The activation signal 130 is input to an operating section 140, which is responsive to the activation signal and which produces an output signal for operating devices, shown generally at 150, that provide a user-perceivable reaction to the input signal for at least a predetermined period of time. The predetermined period of time may for example be set and governed by a timing element conventionally known to those skilled in the art and located in the processing section 120.

Printed circuit board 1 further comprises a processing section 1A and, in a preferred form of the invention, an audio section 1B, and a motor control section 1C which provide the desired signals for generating aural and visual outputs, respectively. The circuit board 1 is electrically interfaced to power source 2, which may for example be a DC power supply that derives its energy from one or more standard A, AA, AAA, or C cells. An alternating current power source could alternatively be used with appropriate circuitry provided on printed circuit board 1.

In a further preferred aspect of the invention, the input section 110 comprises a pair of input devices, which are both in electrical communication with the circuit board 1, for converting external stimuli to the input electrical signal. As used herein, the term "external stimuli" means any input to the circuit from the external (to the inventive device) environment of a person observing, or playing with, the novelty device, whether the person knowingly or unexpectedly creates the necessary stimuli. The first of these input devices in the herein disclosed embodiment is a combination of an on-off switch 3 and stimulus sensing element 4. The on-off switch 3 is connected between the power source 2 and stimulus sensing element 4 and may take the form of a slide switch or a push button switch or the like operable to activate the sensing element 4 to provide an input to the circuit. The sensing element 4 is also connected to the processing section 1A of circuit board 1, and may in a preferred embodiment comprise a piezoelectric sensor or transducer for detection of sound and vibration, although other sensing elements such by way of example as photoelectric cells, motion detectors, and proximity sensors may be employed. When the sensor 4 is activated as by detecting a sound, or by a person walking past or moving proximate the novelty device, the novelty device is activated and emits or effects its responsive sounds and/or actions for a predetermined period of time under the control of processing section 1A.

The second device of input section 110 in the herein disclosed embodiment comprises a manual trigger mechanism 7, such as a momentary push button switch, that is also connected to the processing section 1A. The trigger mechanism 7 is used to manually activate the novelty device, irrespective of the position or state of on-off switch 3. Mechanism 7 permits selective manual operation of the novelty device to produce, without the necessity of generating the stimulus required to activate the element 4, the amusing output of the device for the predetermined period of time. That predetermined period of time is set by a timing circuit found in processing section 1A, as for example a timing chip; other timing elements may alternatively be employed, such as an R-C network, for example, to generate the operating time period. No matter how activated, of course, at the end of the predetermined period the circuit returns to a dormant state until reactivated by the external stimulus by way of sensing element 4 or the manual switch 7.

Motor 6 is connected to the motor control section 1C of circuit board 1 for operating motor 6 when motor control section 1C is energized by processing section 1A. Motor 6 operatively produces an irregular or vibratory motion of the novelty device housing as explained hereinbelow. A speaker 5 is connected to audio section 1B to provide an audible output from the integrated circuit sound chip.

Figure 2:
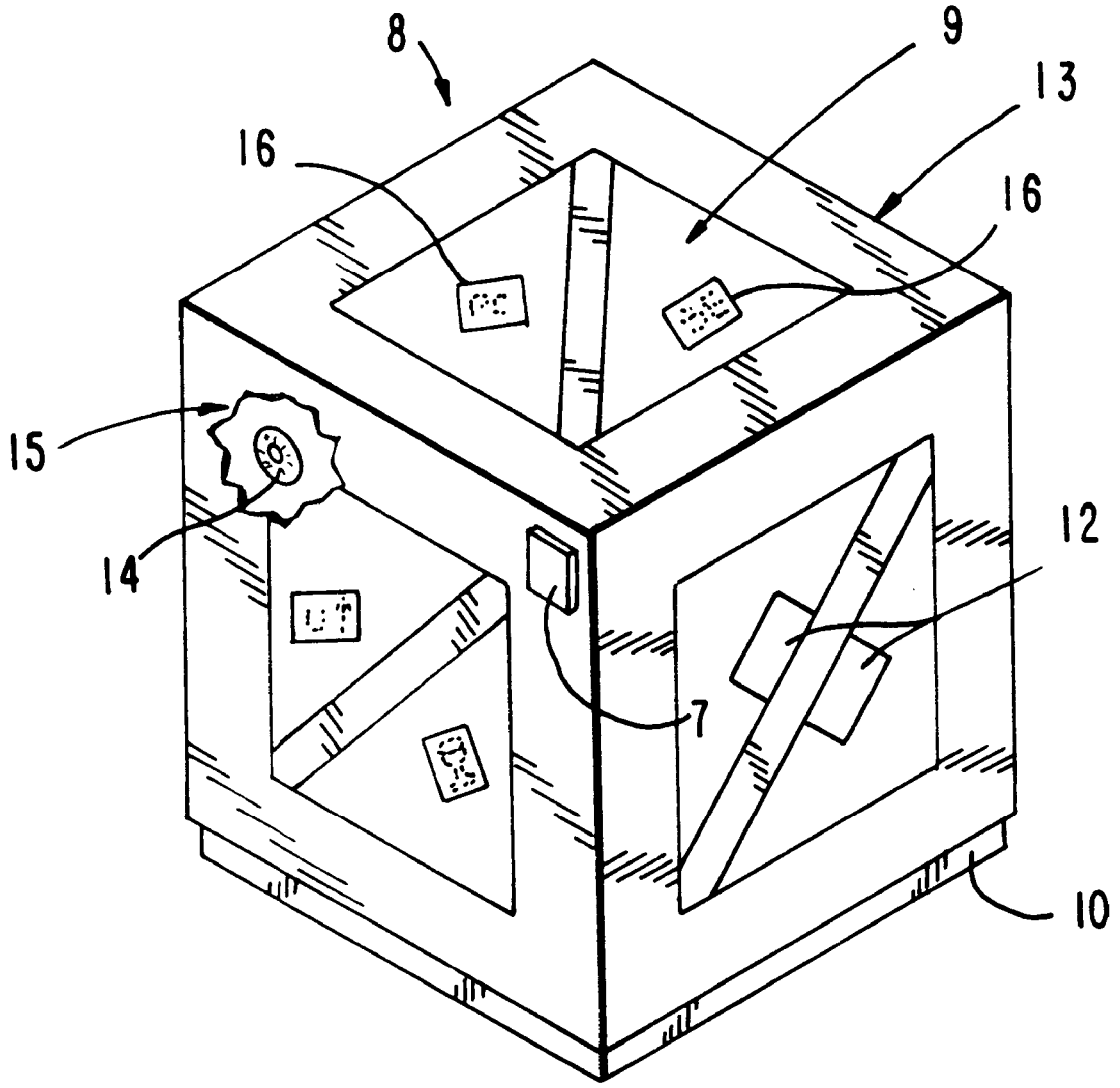
FIG. 2 is an elevated perspective view of a preferred embodiment of the invention.

As is shown in FIG. 2, all of the parts and components hereinabove described are disposed within a substantially closed box-like housing 8 of the novelty device. The housing comprises a top cover 9 carrying a plurality of sidewalls extending integrally downward from a top surface and a base 10, the top cover 9 being removably attached to the base 10 by fasteners 11 (FIG. 4) such as screws. A first set of openings 12, such as slots, may be defined in one of the housing sidewalls or otherwise for proximity to the sensing element 4 to facilitate reception by the element 4 of external stimuli, i.e. sound, motion, light, etc. by the sensing element. Other or additional openings, or conduction or transfer paths, may be provided in or through the housing 8 such, for example, as a transparent or translucent window where the sensing element 4 is a photoelectric cell. The speaker 5 is mounted to an interior surface of the housing 8, such as to one of the sidewalls of top cover 9, in overlying or proximal relation to a second set of openings such as slots through which sound generated by the speaker 5 can audibly reach the user. The mounting of speaker 5 to a housing surface may be effected by any suitable means or arrangement known to those skilled in the art as a general matter of design choice.

As previously noted, housing 8 may be fabricated to resemble a cargo crate carrying typical surface indicia such as shipping labels and the like. Voice sounds and vibratory motion of the housing is likely to suggest to an observer of the novelty device that someone or something is trapped inside the crate. The housing may also be formed so as to resemble other objects such, by way of nonlimiting example, as a barrel, a coffin, a crypt or an outhouse. Any form or configuration of housing which is effective to obscure or cover the circuit and other operating components of the novelty device can be employed in accordance with the invention.

The manual trigger mechanism 7 is mounted in the disclosed embodiment of the device to a sidewall of the housing 9 so as to be externally accessible through an opening defined in the sidewall. The illustrated embodiment also indicates a simulated eyeball 14 which is mounted to the housing sidewall and visible through an associated jagged opening 15 in such a way as to suggest that someone or something trying to escape from within the crate is looking out at the user. Various surface indicia which suggest that the housing 8 is a shipping crate, such as labels 16, are located on the outer surface of the housing, which may further be configured to replicate wood grain and planking. Of course, as should be apparent the housing 8, i.e. top cover 9 and base 10 in the illustrated embodiment, can alternatively be configured to provide any desired appearance as a general matter of design choice.

Figure 3:
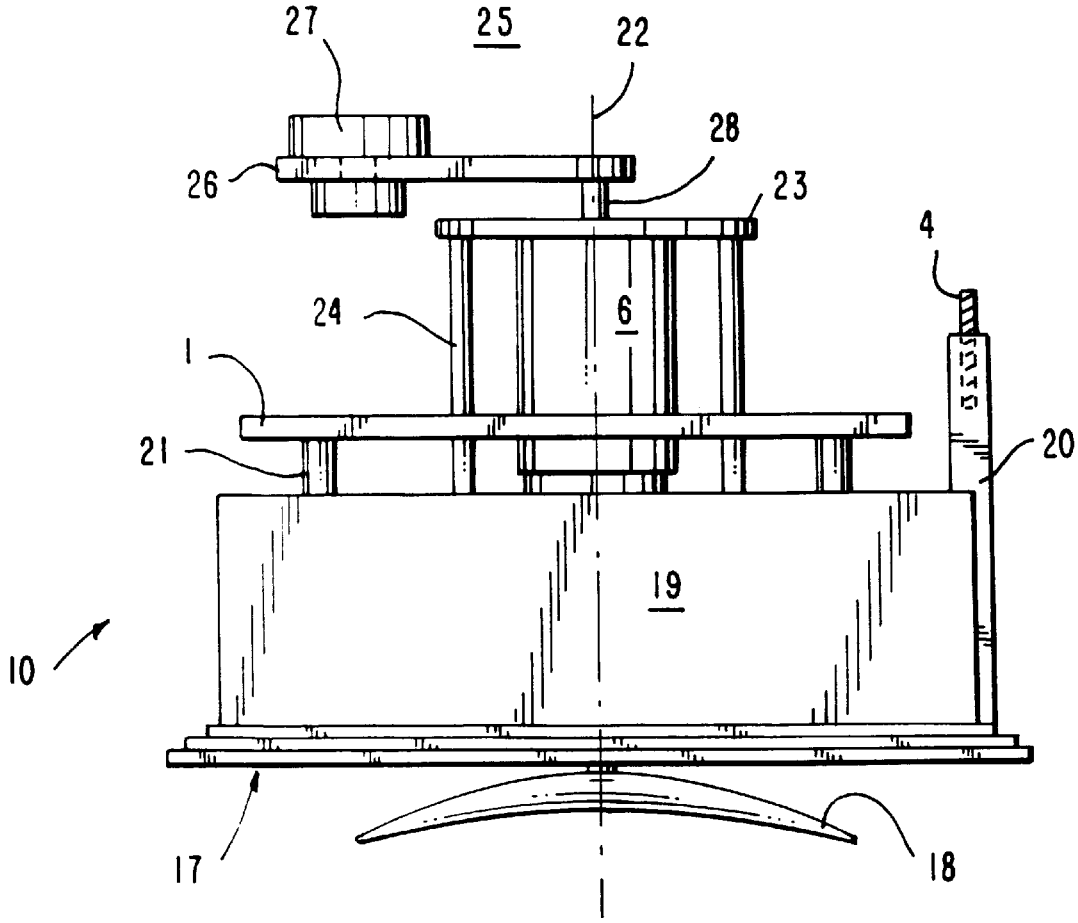
FIG. 3 is a cross-sectional view, broken away, of the novelty device showing the motion generator.

As shown in FIG. 3, the sensing element 4, printed circuit board 1, motor 6 and an access cover 17 (FIG. 4) carrying an attached suction cup 18 are mounted to and carried on the base 10. The piezoelectric transducer disk sensing element 4 is vertically mounted in a slotted holder 20 which is in turn mounted to or configured as a part of the base 10. The slotted holder 20 is located at one end of a battery compartment 19 of the power supply 2 so as to position the sensing element 4 close or in adjacent proximity to the first set of openings 12 as defined in the illustrated embodiment. Those skilled in the art will recognize that although the slotted holder 20 is provided to support the piezoelectric transducer 4, the use of other sensing elements may require or warrant or permit the use of alternative support structures and arrangements.

Likewise, in the illustrated embodiment the circuit board 1 is horizontally mounted to the top of battery compartment 19 via spacers 21. The battery compartment 19 and spacers 21 are formed as part of the base 10. The positions, orientations and configurations of these elements may of course be varied to suit design and mechanical considerations within the contemplation of the invention.

Figure 5:
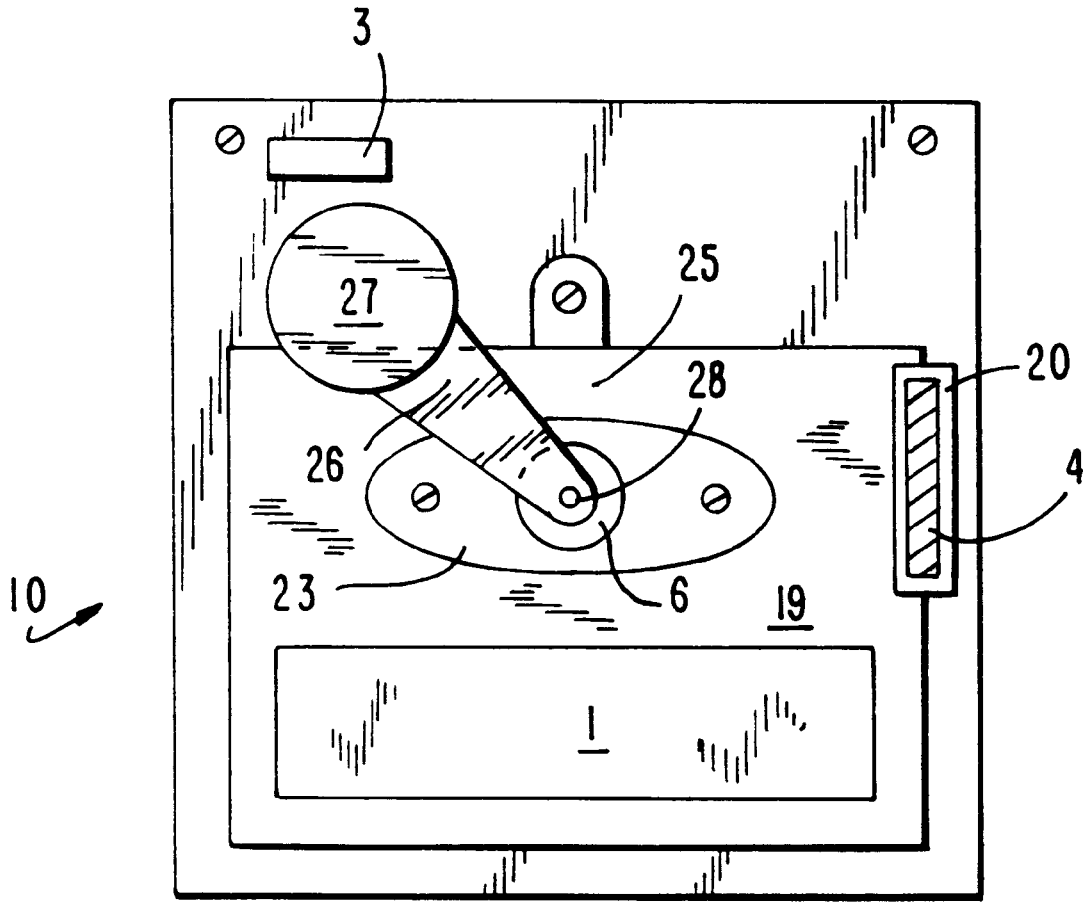
FIG. 5 is a top plan view of the interior of the housing.

The motor 6 is vertically mounted to the top of battery compartment 19, preferably so that its vertically-extending shaft 28 is at least slightly displaced or offset from the center or central vertical axis of the housing and base 10 (FIG. 5). The top end of the motor 6 may be positionally fixed by a horizontal yoke 23 carried on a pair of vertical supports 24 that extend from the top of battery compartment 19. A weighted eccentric 25, comprising an arm 26 and mass or weight 27, is secured to and extends perpendicularly outward from motor shaft 28 for rotation with the shaft. When electrical operating power is applied to the motor 6, the rotation of the weighted eccentric 25 and resulting circular motion of the weight 27 about the axis 22—which is off-center to the base of the housing—the rotating weight 27 produces a vibratory or shaking motion of housing 8, a vibrating motion that is further enhanced by the flexible separation of the housing from its supporting surface by the suction cup 18 so as to suggest that a living being is attempting to escape from within the housing 8. The suction cup 18 is effective to secure or adhere the novelty device to the supporting surface and thereby prevent unintended motion or creep of the housing 8 along the supporting surface as the housing vibrates or shakes.

Those skilled in the art will recognize that, as an alternative or in addition to offsetting the motor shaft 28 from the central axis of the housing, the desired irregular motion of the housing relative to the underlying support surface may be effected by orienting the motor shaft at a slight angle to the vertical. In this manner, rotation of the weight about the resulting non-horizontal plane defined perpendicular to the extension of the motor shaft will result in a substantial rocking motion of the housing similarly suggesting efforts by a trapped being to escape from within the housing.

Figure 4:
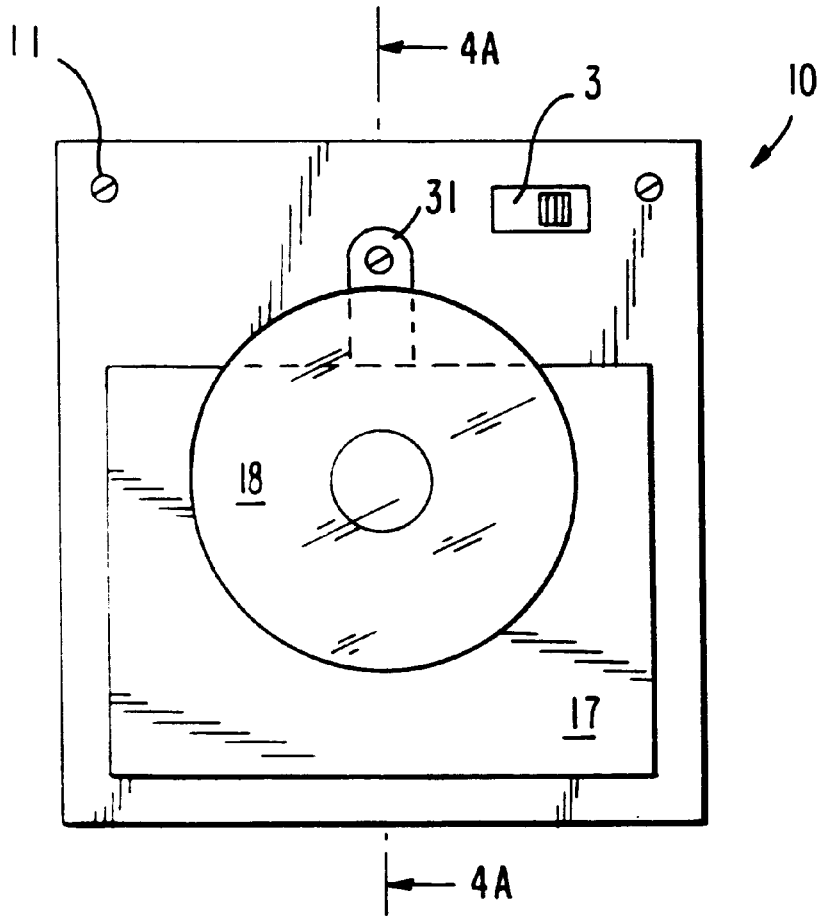
FIG. 4 is a bottom plan view of the housing of the inventive device.
Figure 4A:
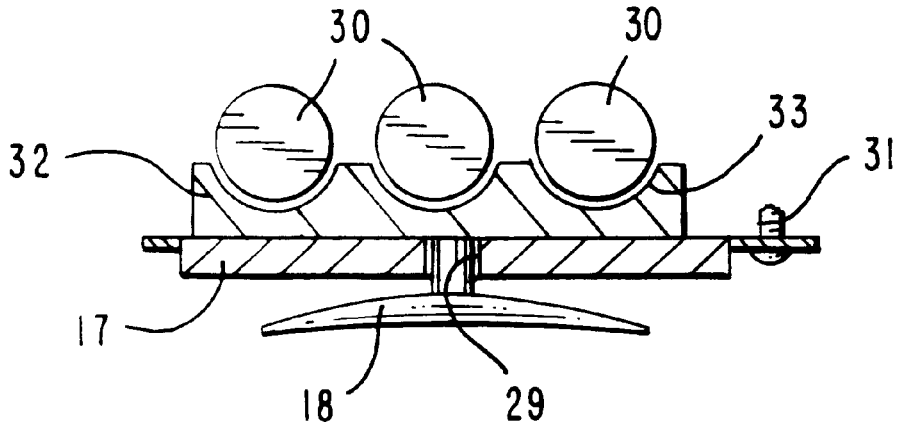
FIG. 4A is a sectional view of the access cover of FIG. 4, taken along the lines 4A—4A in FIG. 4.

As shown in FIGS. 4 and 4A, the access cover 17 closes and forms the bottom of battery compartment 19, thereby facilitating insertion, removal and replacement of the batteries 30. Access cover 17 is releasably attached to base 10 with at least one access cover fastener 31, such by way of example as a screw, to prevent the operating vibratory motion of the housing from unintendedly separating or detaching the access cover from base 10. As is known in the art, the interior surface of the access cover 17 and/or the battery compartment may include one or more ribs 32 and/or arcuate contours complementing the shape of the batteries 30 to prevent the batteries 30 from shaking loose as a result of the operative vibratory motion of housing 8.

The suction cup 18 may for example be secured to the access cover 17 through press fit engagement of a protrusion or boss on the underside of the cup 18 with a bore 29 defined in the access cover 17. The on-off switch 3 may be mounted so as to be operable from the bottom of the base 10, thereby effectively hiding or obscuring the switch in the normal operative orientation of the novelty device.

FIG. 5 depicts a top view of the base 10 with the top cover 9 removed, showing the layout of the components in the herein-disclosed embodiment of the invention, including the printed circuit board 1, on-off switch 3, sensing element 4, battery compartment 19, motor 6, arm 26 and weight 27.

As should be apparent, the particular circuit elements and assemblies and configurations depicted in FIG. 1 and hereinabove described may be modified in any desired or appropriate manner to provide the functionality contemplated and intended in accordance with and without departing from the spirit of the present invention. Similarly, the novelty device can be constructed so that, instead of or in addition to motion of the housing relative to the underlying support surface, a part of or a structural element extending from or associated with the housing may be moved or displaced or manipulated in response to detection of a predetermined externally-originating stimulus. For example, the herein-disclosed embodiment of the invention may be modified to provide a simulated human arm that extends outwardly from the housing interior and which operatively moves back and forth, or in and out, or that alternately extends and contracts the fingers of an extended hand, when the novelty device is actuated to further suggest a frantic effort to escape by a being trapped within the box.

When configured for example in the form of a crate-like housing 8, an unsuspecting person will be surprised and entertained when by inadvertently or intentionally touching or otherwise stimulating or activating the device, the crate shakes and rocks while a simulated voice from within asks to be "let out." Those already familiar with the device and its functioning additionally find it amusing to watch the reactions of others to its operation.

The novelty devices described and disclosed herein thus provide amusement and stress relief for individuals playing with them and observing the device and its effect on others. The devices are simple to manufacture and operate and are safe. By combining various elements of surprise, predetermined activation techniques and times, and sensory amusement, the inventive novelty devices and their methods of manufacture solve long felt and unfulfilled needs in the art for lasting and provocative amusement devices.

While there have been shown and described and pointed out fundamental novel features of the invention as applied to preferred embodiments thereof, it will be understood by those skilled in the art that various omissions, substitutions and changes in the methods described, and in the form and details of the devices illustrated, and in their operation, may be made by those skilled in the art without departing from the spirit and scope of the invention. For example, it is expressly intended that all combinations of those elements and/or method steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A novelty device for generating, in response to a predetermined input, a concurrent plurality of related sensory outputs perceivable by an observer of the device for creating a humorous and unexpected reaction from the observer, comprising:

a substantially closed housing including a base for free-standing support on an underlying support surface;

trigger means associated with the housing for receiving a predetermined stimulus originating external to the housing and for generating an electrical signal in response to receipt by said trigger means of the predetermined stimulus; and operating means in the housing for receiving the generated electrical signal and for generating in response to the received electrical signal the concurrent plurality of observer-perceivable related sensory outputs, said operating means comprising first means for operatively generating an observer-audible sound comprising a simulated voice suggesting that a living being is present within the housing, and second means for operatively creating, concurrent with the generating of said observer-audible sound, an irregular motion of the housing relative to the underlying support surface so as to suggest that the motion of the housing is being created by the living being within the housing in an attempt to escape from the housing;

wherein said first means comprises means for generating a simulated voice uttering "let me out of here".

2. A novelty device in accordance with claim 1, further comprising means in the housing for supplying operating electrical power to said operating means.

3. A novelty device in accordance with claim 1, wherein said operating means further comprises a processor for receiving the electrical signal from said trigger means and for initiating operation of said first and second means in response to receipt of said electrical signal.

4. A novelty device in accordance with claim 1, further comprising a suction cup mounted on the base and releasably securable to the support surface for discouraging movement of the device along the support surface as said second means operatively creates said irregular motion of the housing relative to the support surface.

5. A novelty device in accordance with claim 1, wherein said irregular motion created by said second means comprises a simulated shaking motion of the housing relative to the support surface.

6. A novelty device in accordance with claim 1, wherein said second means comprises a motor operable to rotate a weight disposed within the housing.

7. A novelty device in accordance with claim 1, wherein said first means operatively generates said observer-audible sound for a first predetermined period of time and said second means operatively creates said irregular motion of the housing for a second predetermined period of time at least in part concurrent with said first predetermined period of time.

8. A novelty device in accordance with claim 1, wherein said housing is configured to simulate a box.

9. A novelty device for generating, in response to a predetermined input, a concurrent plurality of related sensory outputs perceivable by an observer of the device for creating a humorous and unexpected reaction from the observer, comprising:

a substantially closed housing including a base for free-standing support on an underlying support surface;

trigger means associated with the housing for receiving a predetermined stimulus originating external to the housing and for generating an electrical signal in response to receipt by said trigger means of the predetermined stimulus; and operating means in the housing for receiving the generated electrical signal and for generating in response to the received electrical signal the concurrent plurality of observer-perceivable related sensory outputs, said operating means comprising first means for operatively generating an observer-audible sound comprising a simulated voice suggesting that a living being is present within the housing, and second means for operatively creating, concurrent with the generating of said observer-audible sound, an irregular motion of the housing relative to the underlying support surface so as to suggest that the motion of the housing is being created by the living being within the housing in an attempt to escape from the housing;

wherein said second means comprises a motor operable to rotate a weight disposed within the housing about an axis defined eccentric to a central axis of the housing and wherein said first means comprises means for generating a simulated voice uttering "let me out of here".

10. A novelty device in accordance with claim 9, wherein said operating means further comprises a processor for receiving the electrical signal from said trigger means and for initiating operation of said first and second means in response to receipt of said electrical signal.

11. A novelty device in accordance with claim 9, wherein said trigger means comprises means for detecting a sound originating external to said housing and for generating said electrical signal in response to detection of said externally-originating sound.

12. A novelty device for generating, in response to a predetermined input, a concurrent plurality of related sensory outputs perceivable by an observer of the device for creating a humorous and unexpected reaction from the observer, comprising:

a substantially closed housing including a base for free-standing support on an underlying support surface;

trigger means associated with the housing for receiving a predetermined stimulus originating external to the housing and for generating an electrical signal in response to receipt by said trigger means of the predetermined stimulus; and operating means in the housing for receiving the generated electrical signal and for generating in response to the received electrical signal the concurrent plurality of observer-perceivable related sensory outputs, said operating means comprising first means for operatively generating an observer-audible sound comprising a simulated voice suggesting that a living being is present within the housing, and second means for operatively creating, concurrent with the generating of said observer-audible sound, an irregular motion of the housing relative to the underlying support surface so as to suggest that the motion of the housing is being created by the living being within the housing in an attempt to escape from the housing;

wherein said trigger means comprises means for detecting a sound originating external to said housing and for generating said electrical signal in response to detection of said externally-originating sound.

13. A novelty device for generating, in response to a predetermined input, a concurrent plurality of related sensory outputs perceivable by an observer of the device for creating a humorous and unexpected reaction from the observer, comprising:

a substantially closed housing including a base for free-standing support on an underlying support surface;

trigger means associated with the housing for receiving a predetermined stimulus originating external to the housing and for generating an electrical signal in response to receipt by said trigger means of the predetermined stimulus; and operating means in the housing for receiving the generated electrical signal and for generating in response to the received electrical signal the concurrent plurality of observer-perceivable related sensory outputs, said operating means comprising first means for operatively generating an observer-audible sound comprising a simulated voice suggesting that a living being is present within the housing, and second means for operatively creating, concurrent with the generating of said observer-audible sound, an irregular motion of the housing relative to the underlying support surface so as to suggest that the motion of the housing is being created by the living being within the housing in an attempt to escape from the housing;

wherein said housing is configured to simulate a box.

14. A novelty device in accordance with claim 13, wherein said first means comprises means for generating a simulated voice uttering "let me out of here".

15. A novelty device in accordance with claim 13, wherein said trigger means comprises means for detecting a sound originating external to said housing and for generating said electrical signal in response to detection of said externally-originating sound.

16. A novelty device in accordance with claim 13, wherein said operating means further comprises a processor for receiving the electrical signal from said trigger means and for initiating operation of said first and second means in response to receipt of said electrical signal.

17. A novelty device in accordance with claim 13, further comprising a suction cup mounted on the base and releasably securable to the support surface for discouraging movement of the device along the support surface as said second means operatively creates said irregular motion of the housing relative to the support surface.

18. A novelty device in accordance with claim 13, wherein said irregular motion created by said second means comprises a simulated shaking motion of the housing relative to the support surface.

19. A novelty device in accordance with claim 13, wherein said second means comprises a motor operable to rotate a weight disposed within the housing.

20. A novelty device in accordance with claim 13, wherein said first means comprises means for generating a simulated voice uttering a sound suggesting that the living being is seeking to escape from within the housing.

21. A novelty device for generating, in response to a predetermined input, a concurrent plurality of related sensory outputs perceivable by an observer of the device for creating a humorous and unexpected reaction from the observers, comprising:

a housing including a substantially closed portion and a base for freestanding support on an underlying support surface;

trigger means associated with the housing for receiving a predetermined stimulus originating external to the housing and for generating an electrical signal in response to receipt by said trigger means of the predetermined stimulus; and operating means in the housing for receiving the generated electrical signal and for generating in response to the received electrical signal the concurrent plurality of observer-perceivable related sensory outputs; said operating means comprising first means for operatively generating an observer-audible sound comprising a simulated voice suggesting that a living being is present within the substantially closed portion of the housing, and second means for operatively creating, concurrent with the generating of said observer-audible sound, an irregular motion of the housing relative to the underlying support surface so as to suggest that the motion of the housing is being created by the living being within the substantially closed portion of the housing in an attempt to escape from the substantially closed portion of the housing;

wherein said first means comprises means for generating a simulated voice uttering words suggesting that the living being is seeking to escape from within the substantially closed portion of the housing, wherein the simulated voice of said first means utters the words "let me cut of here".

* * * * *